United States Patent [19]

Humann

[11] Patent Number: 4,730,858

[45] Date of Patent: Mar. 15, 1988

[54] CARPET STRETCHER TOOL

[76] Inventor: Theodore N. Humann, 6353 Wilryan Ave., Edina, Minn. 55435

[21] Appl. No.: 403,296

[22] Filed: Jul. 30, 1982

[51] Int. Cl.[4] ..... A47G 47/04; A47G 27/04

[52] U.S. Cl. ..... 294/8.6; 254/200; 254/212

[58] Field of Search ..... 294/8.6; 254/200, 201, 254/202, 203, 204, 205, 206, 207, 208, 209, 210, 211, 212

[56] References Cited

U.S. PATENT DOCUMENTS

| | | | |
|---|---|---|---|
| 796,433 | 8/1905 | Kahn . | |
| 3,706,440 | 12/1972 | Ross | 254/212 |
| 3,752,440 | 8/1973 | Ream | 254/209 |

*Primary Examiner*—James B. Marbert

*Attorney, Agent, or Firm*—Paul L. Sjoquist

[57] ABSTRACT

A tool for grasping outside wall corners for providing a stable support base, and for supporting an end of a carpet stretching machine, having an elongated center section and oppositely facing approximate right angle bends at either end of the center section.

8 Claims, 3 Drawing Figures

CARPET STRETCHER TOOL

BACKGROUND OF THE INVENTION

The present invention relates to tools for stretching carpets, and more particularly to carpet stretching tools utilized in commercial carpet laying activities wherein carpeting is typically attached along wall edges.

In the commercial practice of carpet laying, it is well known to utilize certain carpet stretching machines to adequately stretch carpeting which typically lays across an entire room. Such carpeting is usually tacked along a single wall edge initially, and a carpet stretching machine is supported along this wall edge at one of its ends, while the other end is positioned proximate an opposite wall and is temporarily attached into the loose carpet end along this opposite wall. Such machines typically have a padded anvil against which the carpet layer exerts tensile force to tend to stretch the carpeting across the room. After a suitable amount of force is applied and the carpet is stretched to lay flat the carpet layer secures the loose carpet end along the opposite wall edge. The carpet layer frequently moves his stretching machine to different positions along the loose carpet end, stretching the carpet at each position and retacking the loose end carpet to the wall edge. Sometimes carpet tack strips are utilized, which have a plurality of curved tacks preassembled along a narrow wooden strip, and the carpet layer merely hooks the loose end of the carpeting at an appropriate stretched position over this tacked strip. At other times, the carpet layer nails tacks directly through the carpeting into the base floor. The stretching operation is necessary to smooth out the carpeting and to ensure that a completely flat appearance is obtained after the carpet has been secured along all room edges.

Typical carpet stretching machines are adaptable for use in various room sizes. Such carpet stretching machines usually have a base end having a relatively flat bottom surface for supporting against a wall, and have pivotally attached thereto a tubular section facing outwardly from the wall. One or more additional tubular sections maybe conveniently attached to this first section to accommodate room sizes of varying dimensions, the last such section having an end piece adapted for grasping into the carpet surface to cause the stretching action. This end of the machine also typically has a padded anvil or similar device against which an operator may exert considerable force. In a typical operating situation the operator utilizes his leg to sharply contact the anvil and thereby cause the end of the device which is embedded into the carpeting to move or stretch the carpeting outwardly away from the opposing wall. This operation may be repeated a number of times until the desired degree of carpet stretching is achieved. Once the carpet has been properly stretched in this manner, it may be secured along the opposite wall edge according to any of a number of well known commercial practices.

The use of a carpet stretching machine is sometimes awkward in rooms having unusual geometries. For example, rooms having irregular or short wall sections projecting out to form outside corners within the room itself frequently do not provide a sufficient supporting base to securely hold the carpet stretching tool while the stretching operation is performed. In such rooms, it may frequently be difficult to adequately stretch the carpeting uniformly throughout the room, with the net result that noticeable bulges and raised sections are observable in the carpeting even after it has been secured. Inadequate carpet stretching may not become apparent until sometime after the carpet is installed, when temperature and humidity conditions change sufficiently to cause some expansion in the original carpet material. A carpet may therefore sometimes appear to be fully stretched and adequately laid upon initial installation, but may show bulges and raised portions many weeks after the initial installation. In such cases it is frequently necessary to re-stretch the carpeting, again utilizing one of the commercial carpet stretching tools. Depending upon the nature and location of loose areas of carpeting, it may be necessary to apply stretching forces longitudinally, laterally, or diagonally across a room geometry. It is therefore important to be able to utilize the carpet stretching tool in any of a wide variety of operating positions.

SUMMARY OF THE INVENTION

The present invention increases the flexibility and capability of most standard commercial carpet stretching machines. The invention comprises a Z-shaped bracket, preferably coated with plastic or other material for protective reasons, the bracket having an elongated center section for supporting against the carpet stretching machine, and having oppositely facing approximately right angle bends at either end of the center section. As described, the tool has a first approximate right angle bend for securing against an outside corner within a room, and a second oppositely directed approximate right angle bend projecting into the room and for supporting against a carpet stretching machine. The tool permits standard commercial carpet stretching machines to be utilized in a greatly increased number of operating positions, and permits utilization of such machines in a number of room configurations which were previously difficult to work with.

Accordingly, it is a principal object of the present invention to provide a carpet stretcher tool for enhancing the flexibility of carpet stretching machines.

It is another object of the present invention to provide a carpet stretching tool adapted for attachment against an outside corner in a room.

It is yet another object of the present invention to provide a tool for supporting a carpet stretching machine in a wide variety of operating positions.

BRIEF DESCRIPTION OF THE DRAWINGS

The foregoing and other objects will become apparent upon reading the attached specification and claims, and with reference to the appended drawings, in which:

DESCRIPTION OF THE PREFERRED EMBODIMENT

Figure 1:
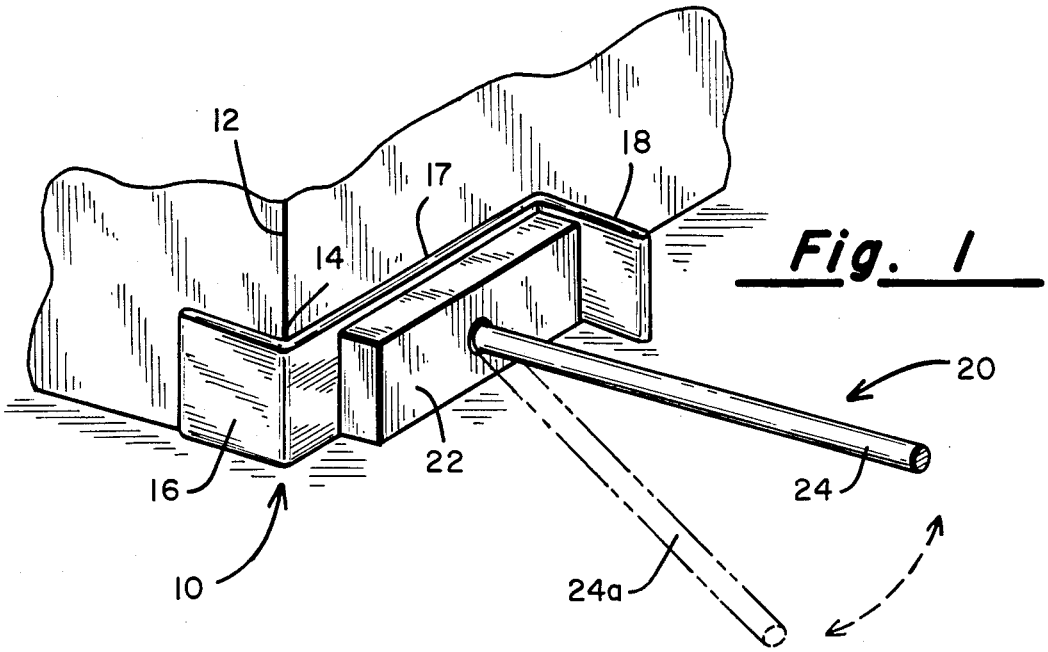
FIG. 1 shows an isometric view of the invention in typical operation.

Referring first to FIG. 1, there is shown an isometric view of the invention in a typical operating position. Tool 10 is placed against a wall section, having one of its ends 16 extending around corner 12 of the wall section. An elongated center section 17 is positioned adjacent the wall surface, and a further end 18 extends outwardly from the wall. A carpet stretching machine 20 has a butt end 22 nested against end 18 and center section 17 for supporting purposes. Carpet stretching machine 20 has a pivotal tubular member 24 extending outwardly from butt end 22 according to the well-known construction features of such machines. The tubular member may be adjusted to a number of different pivotal positions as is exemplified by 24*a* in FIG. 1.

Figure 2:
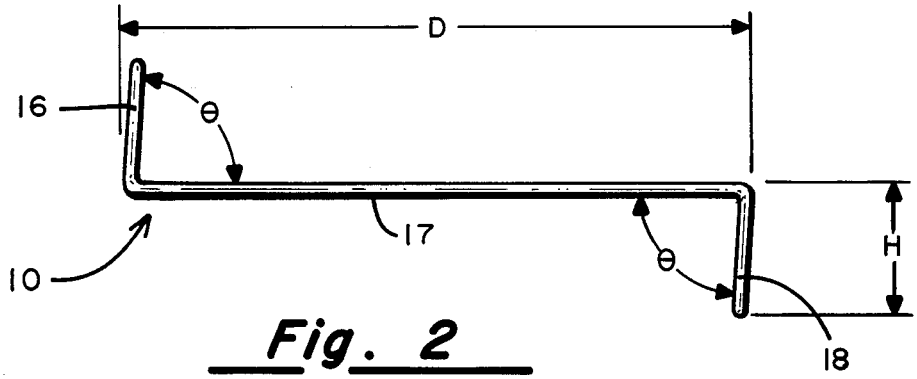
FIG. 2 shows a top plan view of the invention.

FIG. 2 shows a top view of tool 10. End 16 is bent at an angle $\theta$, which is preferably several degrees less than 90°, to form nearly a right angle bend with respect to center section 17. Similarly, end 18 is bent in an opposite direction to approximately the same angle $\theta$. In a preferred embodiment, ends 16 and 18 are approximately of the same length, and it has been found that the dimension "H" should preferably be about three inches. Center section 17 has a length "D", preferably about nine inches.

Figure 3:
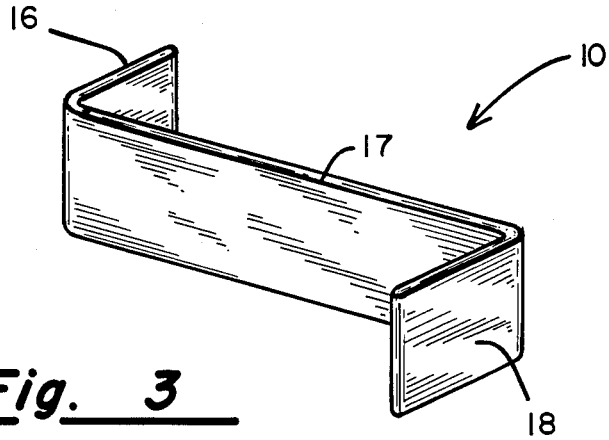
FIG. 3 shows a side isometric view of the invention.

FIG. 3 shows an isometric view of tool 10, which is preferably coated with a PVC plastic or similar material in order to prevent abrasive contact against wall surfaces. The plastic or other coating material which is applied to tool 10 is preferably applied to all exterior surfaces, thereby completely encasing tool 10 in a protective sheath. Tool 10 is preferably made from steel, of approximately 7 gauge thickness.

In operation, the tool is utilized as shown in FIG. 1, with one end secured around an outside wall corner and the other end facing inwardly toward the room. A carpet stretching machine butt end is nestled or seated within the supporting angle provided between center section 17 and the projecting end, to thereby provide stable support for the carpet stretching machine during a carpet stretching operation. Since the tool is merely supported against a wall surface, and is not otherwise secured or attached to the wall surface, it may be readily removed after the stretching operation has been completed.

The present invention may be embodied in other specific forms without departing from the spirit or essential attributes thereof, and it is therefore desired that the present embodiment be considered in all respects as illustrative and not restrictive, reference being made to the appended claims rather than to the foregoing description to indicate the scope of the invention.

What is claimed is:

1. A tool for cooperative use with a carpet stretching machine, comprising (a) a planar center section having a length greater than its width, and having two opposing flat surfaces encompassing substantially the entire length and width of said center section;

(b) a first end section depending from one end of said center section at approximately a right angle, said first end section having two flat opposing surfaces extending from respective center section flat surfaces to form an unobstructed L-angle extension; and (c) a second end section depending from a second end of said center section at approximately a right angle, said second end section being oppositely directed from said first end section, and said second end section having two flat opposing surfaces extending from respective center section flat surfaces to form an unobstructed L-angle extension.

2. The apparatus of claim 1, wherein the angle of said respective first and second end sections is less than 90° but greater than 85°, relative to said center section.

3. The apparatus of claim 1, further comprising an outer layer of plastic material covering all of said center section and said first and second end sections.

4. The apparatus of claim 1, wherein said center section is approximately nine (9) inches in length.

5. The apparatus of claim 4, wherein each of said first and second end sections is approximately three (3) inches in length.

6. The apparatus of claim 2, further comprising an outer layer of plastic material covering all of said center section and said first and second end sections.

7. The apparatus of claim 6, wherein said center section is approximately nine (9) inches in length.

8. The apparatus of claim 4, wherein each of said first and second end sections is approximately three (3) inches in length.

* * * * *